United States Patent [19]

Durrell

[11] 4,392,410

[45] Jul. 12, 1983

[54] ULTRASONIC LOADING OF EXTRUDABLE PLASTIC BONDED EXPLOSIVES

[75] Inventor: Robert R. Durrell, Columbia, Md.

[73] Assignee: The United States of America as represented by the Secretary of the Navy, Washington, D.C.

[21] Appl. No.: 279,644

[22] Filed: Jul. 2, 1981

[51] Int. Cl.[3] ..... C06B 21/00

[52] U.S. Cl. ..... 86/1 R; 264/3 R; 264/23; 425/174.2

[58] Field of Search ..... 86/1 R; 264/3 R, 23, 264/24, 69; 425/174, 174.2

[56] References Cited

U.S. PATENT DOCUMENTS

| | | | |
|---|---|---|---|
| 3,194,855 | 7/1965 | Jones et al. | 264/23 |
| 3,326,787 | 6/1967 | Jacobs | 264/69 |
| 3,479,695 | 11/1969 | Fischbach | 425/174 |
| 3,600,486 | 8/1971 | Walker et al. | 264/3 R |

*Primary Examiner*—Leland A. Sebastian

*Attorney, Agent, or Firm*—R. S. Sciascia; A. L. Branning; J. C. LaPrade

[57] ABSTRACT

A method for loading a plastic bonded explosive by the use of ultrasonic vibrations and moderate pressure.

9 Claims, 5 Drawing Figures

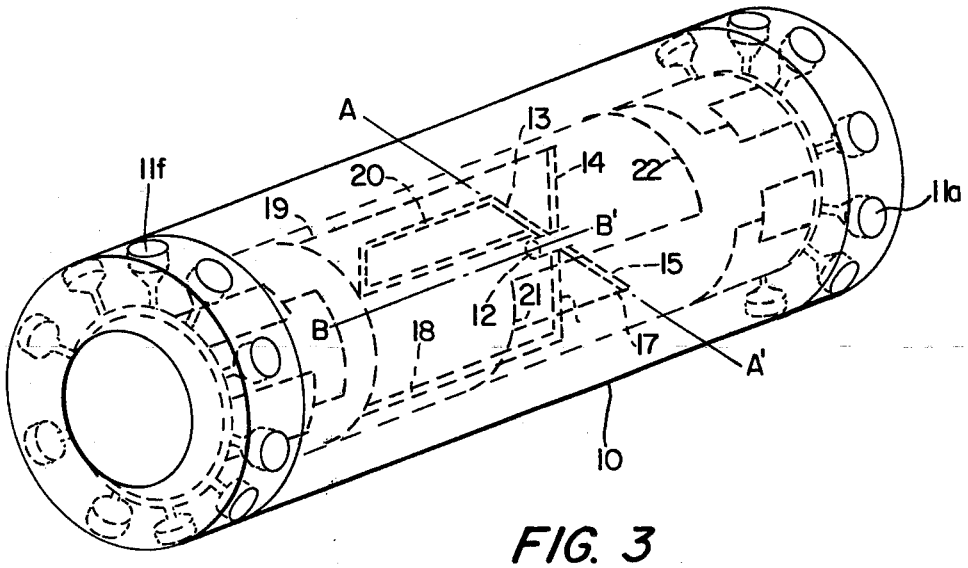
FIG. 3
FIG. 4
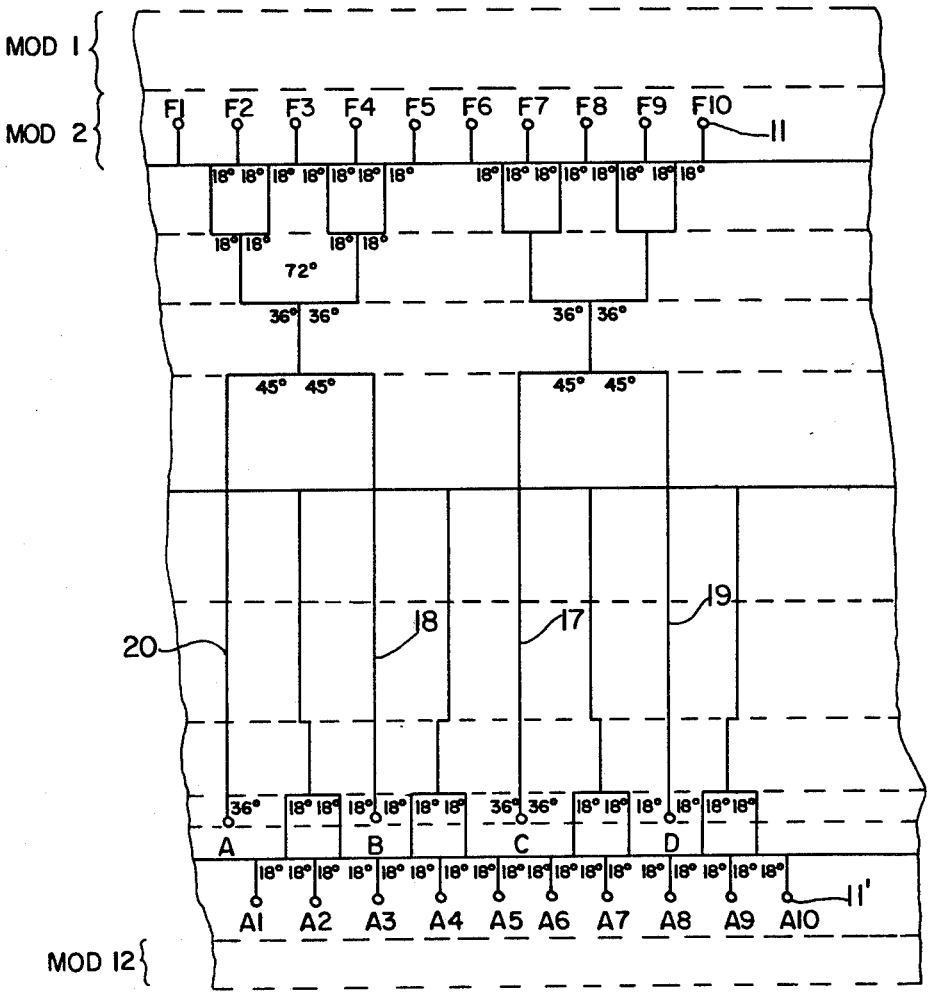

ULTRASONIC LOADING OF EXTRUDABLE PLASTIC BONDED EXPLOSIVES

BACKGROUND OF THE INVENTION

It has been commonplace in the art of manufacturing warheads and other explosive devices to extrude plastic explosives at high pressures. When plastic bonded explosives are extruded into a steel or other metallic warhead or warhead initiator, pressures in the range of 5000 to 10,000 psi have been used.

Pressures in excess of 2500 psi cannot be used to extrude plastic bonded explosives into low yield materials such as plastics, plexiglass or other well known acrylic plastics. Therefore the use of novel light weight materials such as plexiglass that are tremendously advantageous in missiles and rockets have been excluded.

SUMMARY OF THE INVENTION

The invention comprises a method for extruding a plastic explosive composition such as PBXN—301 into small channels in plastic or other low yield material. The length to diameter ratio of these channels is in the range of 100 to 1 to 500 to 1. In this range of L/D the current art is not feasible since the high pressures required for extrusion would cause cracks and fissures, in the low yield material which constitutes a severe safety hazard to the loading personnel.

The new method, broadly stated involves applying a low level of pressure (1000 to 2000 psi) combined with an ultrasonic vibration to aide extrusion of plastic bonded explosives into the channels.

The invention is usually accomplished with a specially designed nozzle, a curved coupler, that is an acoustically tuned exponential horn and conventional extrusion apparatus in combination with an ultra sonic transducer that applies at least 20,000 Hertze per sec. to the extruder.

OBJECTS OF THE INVENTION

It is one object of the invention to provide a novel method of extruding a plastic bonded explosive.

It is one additional object of the invention to provide a method of extruding an explosive material at relatively low pressures and combined with ultrasonic vibration levels to give new and unexpected results.

It is one still further object of the invention to provide a novel method of extruding a plastic bonded explosive into a plastic warhead or warhead initiator where the plastic has a low yield.

It is one additional object of the invention to provide a novel method of extruding an explosive material into long, small diameter conduits get faster rates and more efficiently than by the prior art extrusion methods.

It is also one principal object of the invention to provide a novel combination of elements for extrusion of plastic bonded explosives.

BRIEF DESCRIPTION OF THE DRAWINGS

FIG. 3 is a perspective view of an initiator showing the channels to be extruded using the invention.

FIG. 4 is schematic illustration of the network channels to be extruded with plastic bonded explosives.

DESCRIPTION OF THE PREFERRED EMBODIMENT

The material PBX N 301 is a well known explosive composition. The material specification 12612A was written on Dec. 10, 1975 and discloses the composition on page 3. This Material specification 12612A is incorporated herein by reference. Other plastic bonded explosives are fully operative and can be used in the practice of this invention.

The weapons specification, No. 12612A is available to the public by writing to the Commanding Officer, NOL, Code 8022 Louisville, Ky. 40214.

Figure 1:
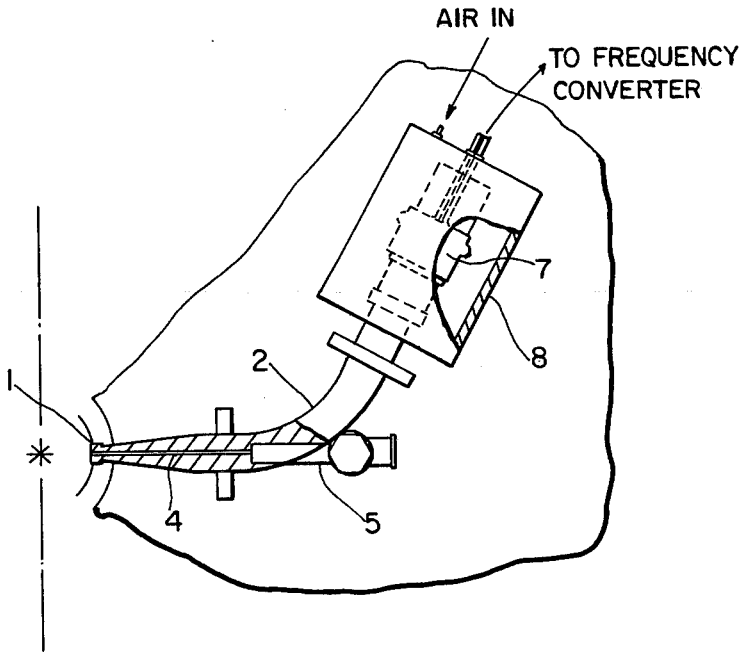
FIG. 1 is a partially cut sway top view of an assembly of the extrader with ultrasonic vibrator elements.
Figure 2:
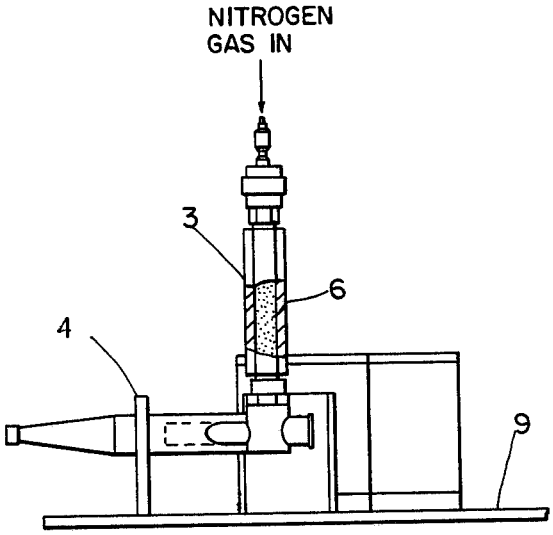
FIG. 2 is a side view of the extruder assembly, illustrating the pressurizing gas port.

In FIGS. 1 and 2, the tapered nozzle 1 is in tight fitted contact with the work piece. The nozzle 1 is affixed to the curved coupler 2. Nitrogen or other inert gas is admitted through a hydro static chamber which contains the plastic bonded explosive, which when pressuried is extruded through a small conduit in nozzle 1 is provided with a suitable adaptor 5 to interface with the preloaded hydrostatic chamber 3 containing a plastic bonded explosive 6 such as PBXN-301 or other plastic bonded explosive such as LX-13. The plastic bonded explosive is fed into the small conduit in nozzel 1 by a compressed gas such as nitrogen or other inert gas. The ultrasonic transducer 7 is contained in an aluminum box 8 through which air may be pumped to provide cooling and positive pressurization to prevent the entry of any extraneous materials.

The curved coupler is mounted to platform 9 by two vibration dampening mounts 10.

FIG. 3 illustrates a generally cylindrical warhead initiator 10 which is of the type demonstrated to require the use of this invention for leading the explosive channels. It is fitted with a radial row of large holes 11(*a*) at the aft end and 11(*f*) at the forward end of the initiator. The nozzle, 1 in FIG. 1 is inserted into these holes and after loading it is removed and output booster pellets installed.

The plastic bonded explosive is extruded throughout the hydra pattern until arriving at the initiator input channel 12, located near the center of the warhead. The hydra-pattern of the initiation transfer material may be extruded PBXN-301 or any other equivalent initiator material that may preferably have the consistency of putty or moist clay. Each of the initial lateral channels, 1, 1, 1 and 16 radiate out from the input channel 13 and each intersects with a vertical conduit 17, 18, 19 and 21. Two of these vertical lines 17 and 20 are also redirected to run toward the aft end of the warhead. The entir hydra-pattern is monolythcally extruded in this manner.

FIG. 4 is a flat achematic depiction of the hydra pattern shown in part in FIG. 3. In FIG. 4 the forward booster pellets 11(*f*) are designated F1 through F10. The aft booster pellets, designated as A1 through A10. The initial lateral channels, 13 through 16, are shown in FIG. 3 and designated as A, B, C, & D and occur at mod 9 in FIG. 4. These four equally spaced apart at 90° angles then intersect with four vertical conduits that are designated as 17–19, and 20.

FIG. 4 discloses a total of 10 layers between 11(*a*) and 11(*f*) each of which represents a modules block 1.0 inch thick and preferable made of plastic, i.e., lexan, plexiglass, etc. Each of these plastic modules has one or more 1 mm vertical a volume equal to 1 mm in diameter conduit. The lateral grooves in a particular modular unit intersect with a number of vertical conduits.

The lateral grooves, which are filled with a molded explosive such as PBXN—301 or an equivalent plastic bonded explosive always appear at the interface between modular blocks and are in fact segments of a circle having a radius of 1.5 inches. The total length of the hydra-pattern may thus be calculated as the sum of length of the circular segments lying along any path between the initiator inputchannel 12 of FIG. 3 and any output booster pellet 11(F) or 11(*a*) of FIG. 3. In the case at hand this length is calculated:

$$1.0\ (10\ \text{modules}) + \frac{(3.0)}{360^\circ}(45 + 36 + 18 + 18^\circ) =$$

$$10 + 3.06 = 13\ 1/16\ \text{inch}$$

since the L/D (13.06/0.045) equals 290 and the prior art will not extrude L/D greater than 100 without using pressure which exceed the yield strength of the plastic, the new invention must be used.

Refering again to FIG. 1 the transducer is electrically connected to a commercially available frequency converter. To operate the ultrasonic extruder the preloaded hydrastatic chamber 3 is removed from the freezer (where it is kept to prevent curing of the PBXN—301) allowed to come up to room temperature and installed as shown in FIG. 1. The regulated compressed nitrogen gas is connected to the hydrostatic chamber 3. The electrical connection to the frequency converter is made. The nitrogen gas is turned on and regulated at approximately 1500 psi and the PBXN—301 begins to extrude. The frequency converter is simultaneously peaked-up to produce an accoustic impedance balance at approximately 28 KHz. The loading process is remotely monitored and when the unit to be loaded put in place.

The obvious advantage of this system is the ability to extrude PBXN—301 into long three dimensional conduits such as used on the SM-2 warhead initiator, shown in FIG. 3 and in a diagramatic flat pattern in FIG. 4, which have large L/D ratios and which are not loadable using existing techniques. Of equal importance is the ability to load at reduced pressures thereby increasing safty. A third advantage is reduced loading time. A typical loading time without ultrasonics is 28° sec/cm length at 5,000 psi for 1 mm diameter channels. These same diameter channels can be loaded ultrasonically at 6.0 sec/cm length at 1,500 psi, but for much greater lengths.

Figure 5:
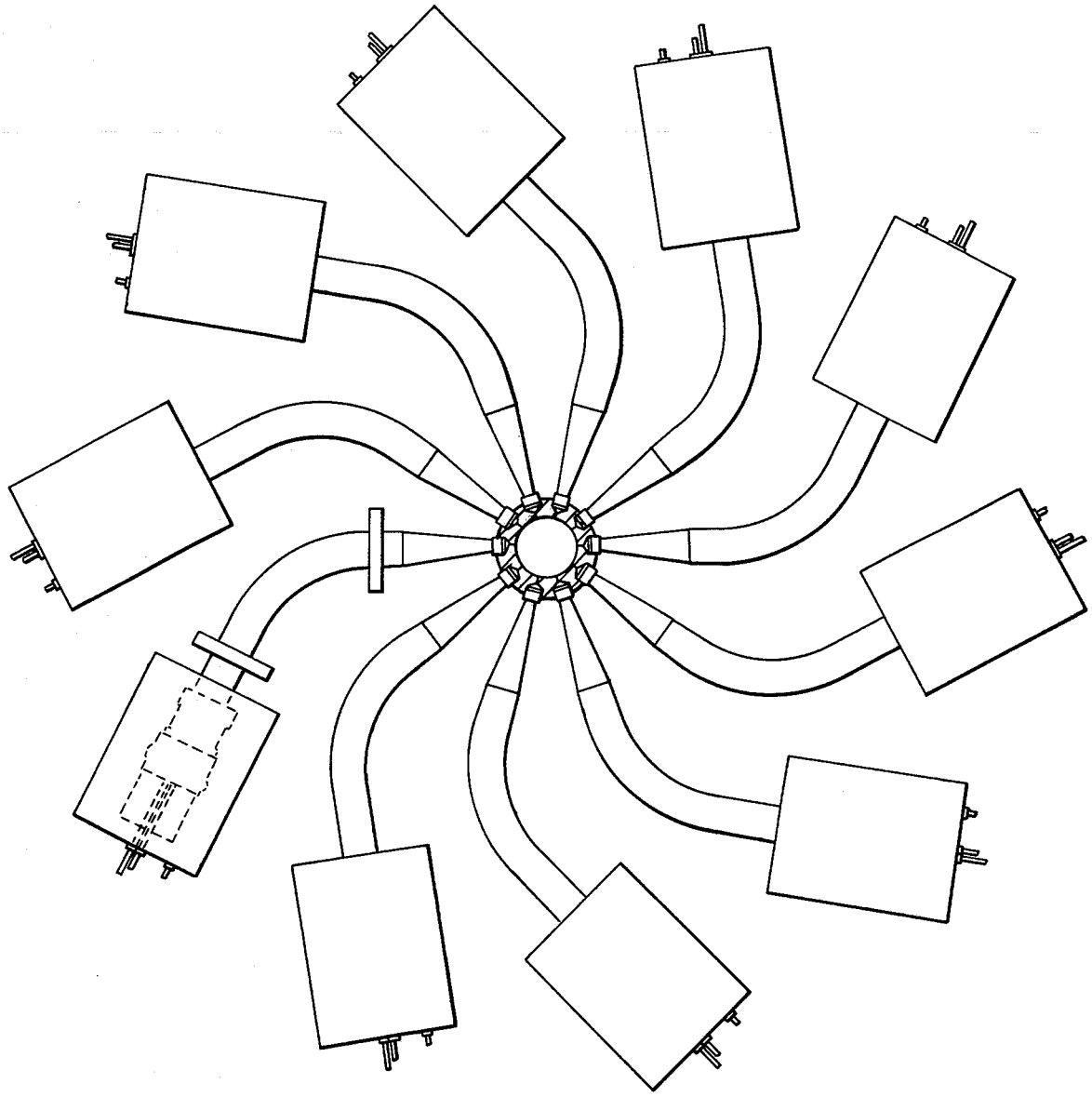
FIG. 5 is a top view of a layout of the extrusion apparatus of the invention in plurality.

For production loading of devices having multiple loading ports, such as the SM-2 warhead initiator, the same basic principles may be applied. A separate curved coupler/transducer assembly is provided for each port as shown in FIG. 5 and the tooling engagement to the initiator is automated. One ultrasonic frequency converter can drive up to ten transducers. PBXC—303 is the experimental designation of the production explosive PBXN 301. PBXN 301 is a mixture of approximately 80% pentaerythritol tetranitrate (PENTN) and 20% silicon resin (sylgard 182), as defined on page 5 on TP 5615 published by Naval Weapons Center, China Lake, CA in October of 1974.

I claim:

1. A method for loading extrudable plastic bonded explosives into long small diameter orifices contained in a warhead initiation system comprising pressurizing the loading system with an inert gas at pressures in the range of 1000 to 2000 psi and providing ultrasonic vibrations on the loading system in the range of from 20K $H_z$ to 30K $H_z$.

2. The method of claim 1 wherein the ratio of length of orifice to diameter of orifice exceeds 200.

3. The method of claim 1 wherein ultrasonic vibrations exceed 20,000 Hertzes per second.

4. The method of claim 1 wherein the gas used to pressurize the extrusion system is nitrogen.

5. Apparatus for ultrasonic loading of extrudable plastic bonded explosive into a warhead initiator comprising in combination, an ultrasonic transducer, an extrusion nozzle, a curved coupler exponential horn, an extrusion cavity, an adapter, a preloaded hydrostatic chamber for loading a plastic explosive composition into the extruder and means to supply pressurized gas at pressures from 1,000 to 2,000 psi to the extrusion cavity.

6. The apparatus of claim 5 wherein the extrusion nozzle is tapered.

7. The apparatus of claim 5 wherein the nozzle is tapered by a Morse taper.

8. The apparatus of claim 5 wherein the ultrasonic transducer produces vibrations in excess of 20,000 hertzes per second.

9. The apparatus of claim 1 wherein the pressure is less than 1500 psi.

* * * * *